US006269823B1

(12) United States Patent
Lincoln

(10) Patent No.: US 6,269,823 B1
(45) Date of Patent: Aug. 7, 2001

(54) CAN WASHING APPARATUS WITH PLASTIC RISERS

(75) Inventor: Thomas C. Lincoln, Ft. Thomas, KY (US)

(73) Assignee: Eagle-Picher Industries, Inc., Cincinnati, OH (US)

( * ) Notice: Subject to any disclaimer, the term of this patent is extended or adjusted under 35 U.S.C. 154(b) by 0 days.

(21) Appl. No.: 09/072,335

(22) Filed: May 4, 1998

(51) Int. Cl.[7] ..... B08B 3/02

(52) U.S. Cl. ..... 134/131; 134/198; 134/130; 239/268; 239/547

(58) Field of Search ..... 134/131, 198, 134/199, 190, 172, 130; 239/73, 209, 268, 547, 450; 248/58

(56) References Cited

U.S. PATENT DOCUMENTS 2,940,458 * 6/1960 Speckman ..... 134/63
3,019,801 * 2/1962 Peterson ..... 134/94
3,262,460 * 7/1966 Huddle ..... 134/72
3,319,640 * 5/1967 La Flame .
3,616,806 * 11/1971 Randall ..... 134/168 R
3,630,448 * 12/1971 Chaplin .
3,659,717 * 5/1972 Bourbina ..... 210/329
3,791,393 * 2/1974 Baldwin .
4,125,120 * 11/1978 Standley ..... 134/126
4,261,831 * 4/1981 Linsenmeyer .
4,709,713 * 12/1987 Kuhl ..... 134/72
4,779,800 * 10/1988 Tuomi .
4,844,106 * 7/1989 Hunter ..... 134/73
4,846,202 * 7/1989 Kallweti ..... 134/122 R
5,257,739 * 11/1993 Pascaru ..... 239/266
5,497,798 * 3/1996 Fritz ..... 134/68
5,564,448 * 10/1996 Lincoln ..... 134/166 R
5,660,196 * 8/1997 Bein ..... 134/129
5,803,318 * 9/1998 Lina ..... 222/321.2
5,862,821 * 1/1999 Rodriguez .
5,862,987 * 1/1999 Reif .

* cited by examiner

*Primary Examiner*—Frankie L. Stinson
(74) *Attorney, Agent, or Firm*—Wood, Herron & Evans, LLP

(57) ABSTRACT

A can washing apparatus includes a supply line or header connected to a plurality of risers. The risers are formed from a plastic material and are held to the frame of the can washing apparatus by an elongated metal support which is in turn welded to the frame of the can washing apparatus. The metal support absorbs the force of the spray thereby preventing the risers from moving and flexing during use.

7 Claims, 4 Drawing Sheets

CAN WASHING APPARATUS WITH PLASTIC RISERS

BACKGROUND OF THE INVENTION

The present invention generally relates to spray washing systems and more particularly to container washing apparatus including one or more liquid supply lines, each having a series of spray nozzles.

Conventional container washing systems utilize a large quantity of spray nozzles, often several hundreds or thousands in number, extending from sides of risers or supply lines. Supply lines are mounted both above and below a liquid permeable conveyor formed of an open mesh material such as plastic or stainless steel. The conveyor moves the containers past the spray nozzles. In such container washing systems, the containers may move along a path often stretching over 100 feet long and pass many different washing, rinsing and treating stations of the system. The spray nozzles at washing and rinsing stations are usually of the type that discharge an elongated, narrow fan spray toward a desired location. Pressurized fan sprays are very effective for washing operations. When oriented correctly and precisely, the use of fan sprays results in full efficient spray coverage and prevents cans from being dislodged or knocked over on the conveyor. The fluid sprays above and below the cans must be precisely aligned in order to prevent the cans from being knocked over and to guarantee proper spray coverage and consequently clean cans.

Maintenance of such systems is extremely difficult. Generally, the sprays extend from the risers at 90° and thus, angled fittings are required. Such angled fittings are disclosed, for example, in U.S. Pat. No. 5,564,448. This patent discloses an apparatus adapted to permit easy removal of the nozzles from the risers. However, the risers are all formed from metal, generally eight to ten feet long. Removal of the risers for maintenance purposes requires at least two or three individuals. It would be desirable to replace the risers with plastic to permit cleaning. Further plastic is corrosion resistant and therefore has a longer life and is less likely to foul. Unfortunately, container washing systems operate at relatively high temperatures and the force of the spray in combination with the high temperature softening of the plastic would cause the risers to move excessively. This in turn would cause the fluid sprays to be misaligned and in turn, knocking the cans over as they pass the washing apparatus.

SUMMARY OF THE INVENTION

Accordingly, it is an object of the present invention to provide a can washing apparatus which includes plastic risers. Further, it is an object of the present invention to provide such an apparatus wherein the plastic risers can be easily removed and wherein the plastic risers are prevented from moving around during use.

The objects and advantages of the present invention are achieved by utilization of a plastic riser which is clamped to an elongated metal support bracket along the entire length of the riser. The metal support bracket in turn is mounted to the can washing apparatus, preventing its movement. Preferably the bracket is mounted to the riser on the side opposite the direction of the fan spray, thus, absorbing all of the force from the fluid spray. Thus, the riser of the present invention can be simply disconnected from the bracket and subsequently from the header or main supply line permitting it to be easily removed by one individual. The objects and advantages of the present invention will be further appreciated in light of the following detailed description and drawings.

DETAILED DESCRIPTION OF THE APPARATUS

Figure 1:
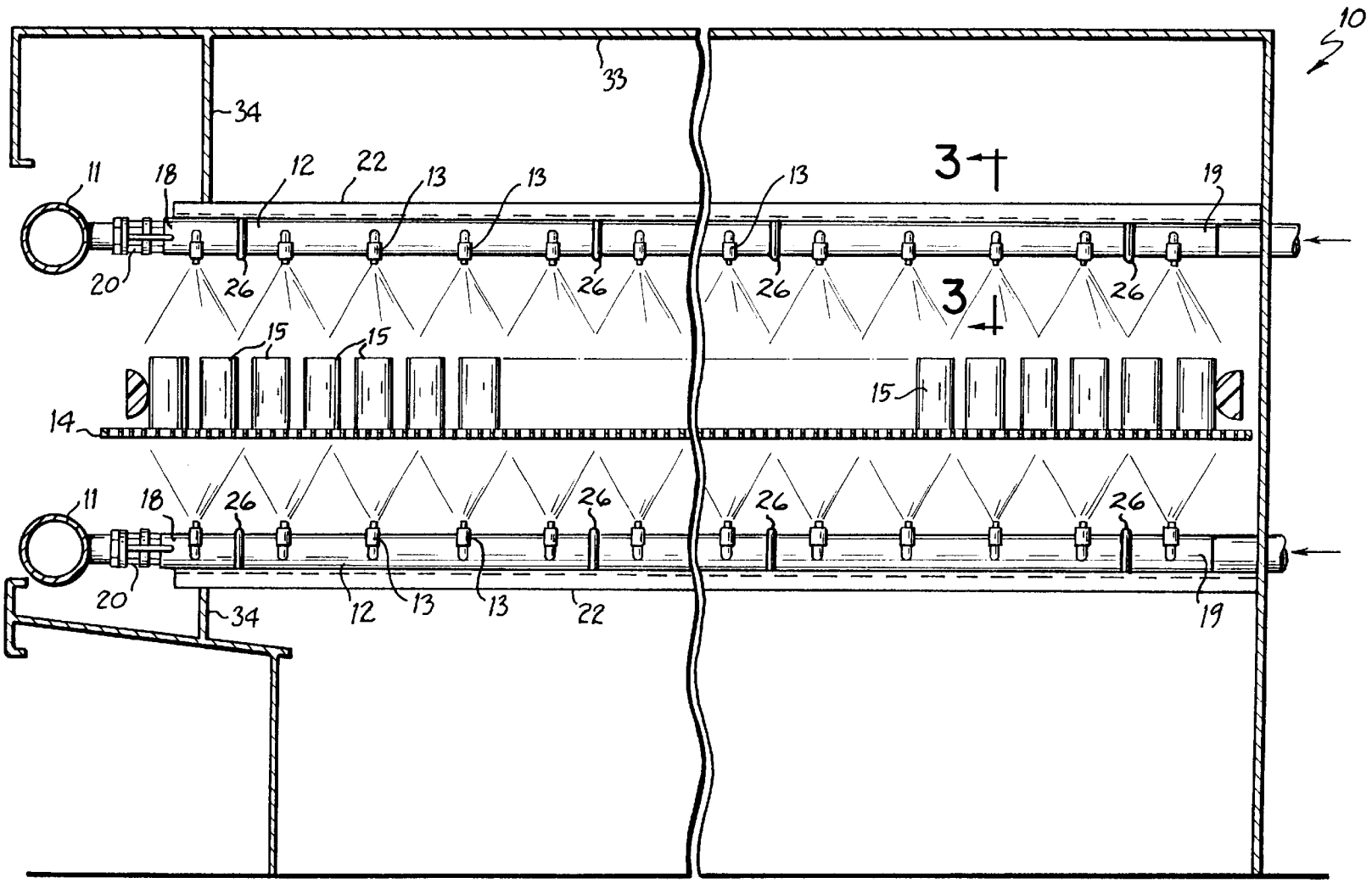
FIG. 1 is a cross-sectional view of a typical can washing apparatus utilizing the present invention.
Figure 2:
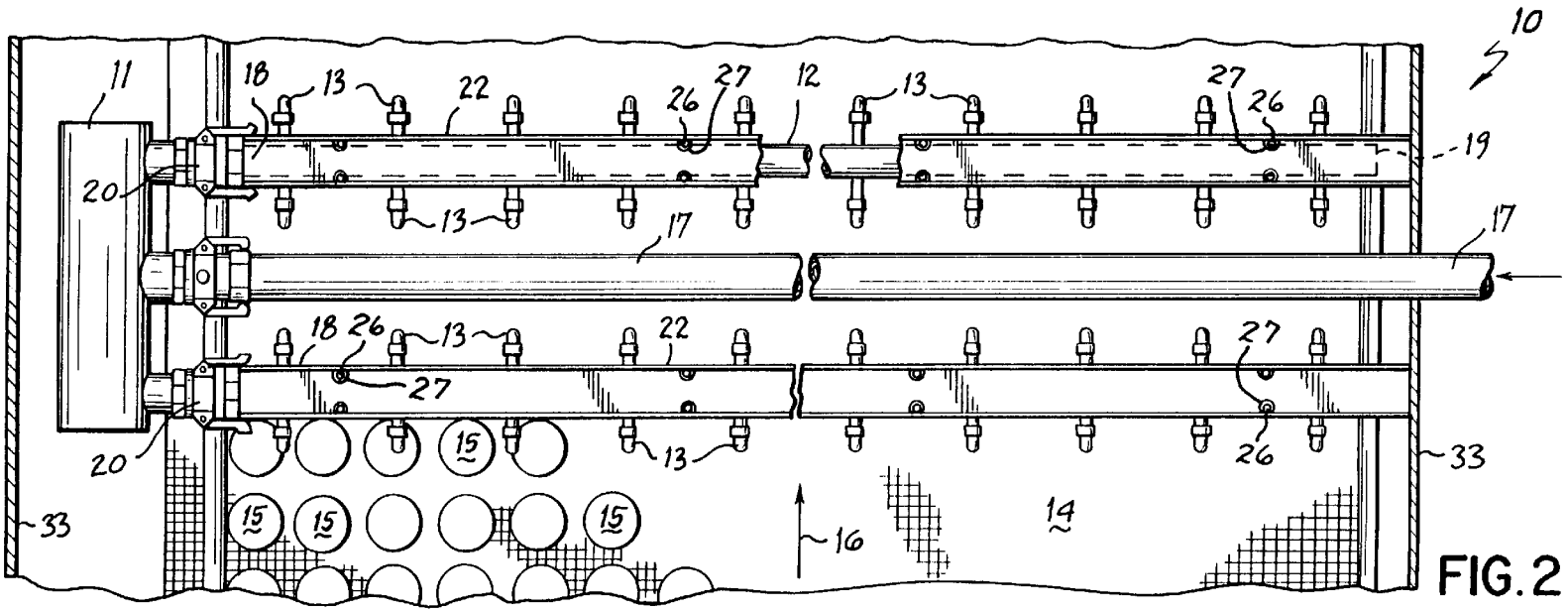
FIG. 2 is an overhead cross-sectional view broken away of a can washing apparatus.

As shown in FIG. 1 there is a can washing apparatus 10 which includes a main supply, or header 11. A plurality of supply lines or risers 12 extend from the header and each of the risers have a plurality of spray nozzles 13. The risers and supply lines extend from above and below a conveyor 14 which supports a plurality of cans 15. As they move along in a direction 16, fluid is supplied to the header 11 through a supply line 17.

The individual risers 12 are all substantially the same. Each riser includes a first end 18 which connects to the header 11 and an opposite closed end 19. A quick-disconnect or compression fitting 20 connects the riser to the supply line 11. Thus, fluid can flow from the supply lines 17 to the header 11 and to the risers 12 where it is dispensed through nozzles 13 onto the cans 15 conveyed between the risers. The drawing shows an offset cam compression fitment. The fitting 20 can be any of a variety of different fittings.

Figure 3:
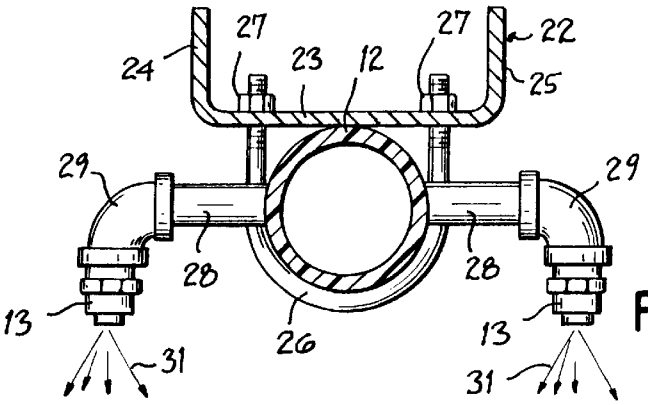
FIG. 3 is a cross-sectional view taken at lines 3—3 of FIG. 1.

The risers themselves are formed from a plastic material, preferably polyethylene or polypropylene although other plastics or other lightweight corrosion resistant materials can be employed. The risers are, in turn, connected to an elongated support 22. Elongated support 22 runs substantially along the entire length of the risers. This, as shown in FIG. 3, is a U-shaped bracket which includes a base 23 and two legs 24, 25. The risers are connected to the base 23 by a plurality of U-bolts 26 fastened with nuts 27. Extending horizontally from either side of the riser are distribution tubes 28 which in turn are connected to angled fittings 29. Nozzles 30 are then attached to the outlet end of the angled fittings 29. Alternately, the angled fitting and nozzle can be replaced by an angled nozzle as disclosed in U.S. Pat. No. 5,564,448. As shown in FIG. 3, this fluid spray extends from the nozzles in a direction shown by arrows 31. The support 22 is fastened to the side of riser 12 which is opposite the direction of the fluid spray so that the force from the fluid spray is absorbed by base 23. The support 22 itself is held to the frame 33 of the can washing apparatus 10 by one or more arms 34 welded to the frame 33 and to support 22.

In operation, the cans 15 are transported on a conveyor 14 in the direction shown by arrow 16. Fluid spray is forced from the nozzles 13 in the direction of arrows 31 from both above and below the cans. Since the conveyor itself is perforated, fluid easily flows through the conveyor striking the cans. The fluid itself is relatively hot and although this will cause softening of the plastic risers, the elongated support 22 will prevent the risers from moving. The force of the fluid is directly opposite the support member 22 so that the support member 22 counteracts all the force from the fluid preventing movement of the riser. The support can be replaced by two or more separate supports as desired. However, a single support is preferred.

Figure 4:
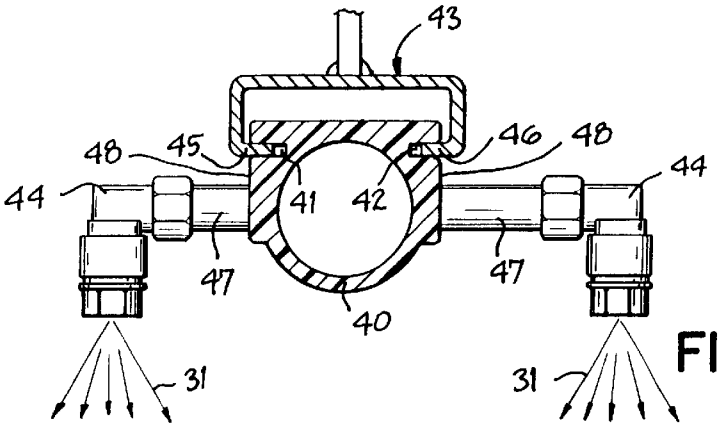
FIG. 4 is a cross-sectional view of an alternate embodiment of the present invention; similar to FIG. 3.

FIG. 4 shows an alternate embodiment of the present invention. In this embodiment the riser 40 itself has a first and second channel 41 and 42. The support member 43 is a C-shaped metal member which has edges 45 and 46 which extend into grooves 41 and 42 holding the riser 40 in position. Therefore, the U-bolts used in the first embodiment of the present invention are not required. The riser simply slides into the channel formed by support member 43 with the edges resting in grooves 40, 41 and 42. In this embodiment, the angled nozzles 44 are employed connected to distribution tubes 47, in turn, screwed into side walls 48 of riser 40. The support member itself 43 is attached by arms 34 to the frame 33 of the can washing apparatus 10 as previously described with the first embodiment of the present invention.

Figure 5:
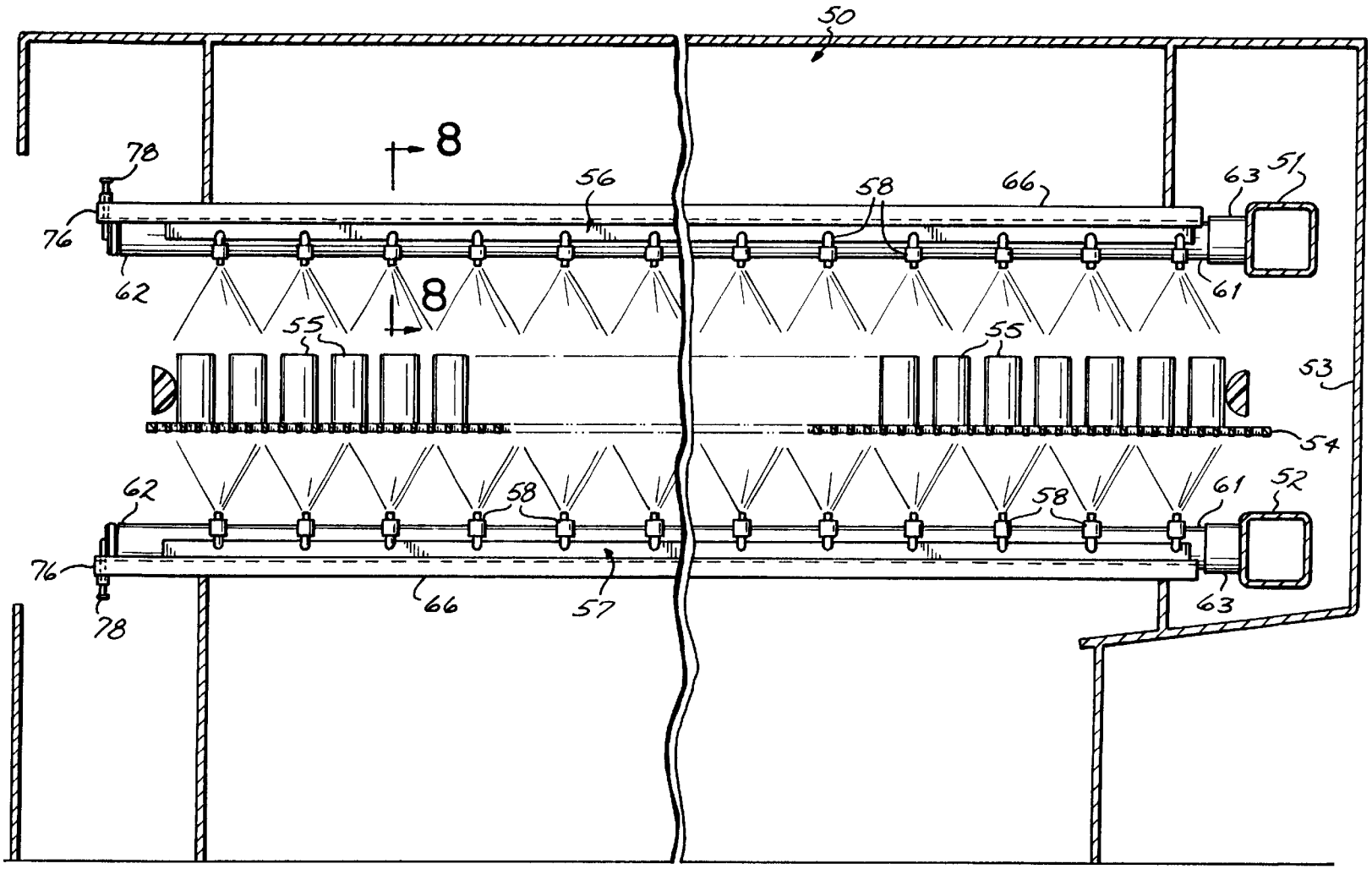
FIG. 5 is a cross-sectional view of an alternate embodiment of the present invention.

Another alternate embodiment of the present invention is shown in FIG. 5. In this embodiment there is a can washing apparatus 50 which is basically a mirror image of can washing apparatus 10. In this embodiment upper and lower header 51 and 52 are located toward inner wall 53 of the apparatus 50. Like can washing apparatus 10, it includes a conveyor 54 which conveys cans 55 between upper and lower risers 56 and 57 respectively. The risers all include a plurality of nozzles 58 which direct a spray upon the cans 55 as they are passed between the risers.

Upper and lower risers 56 and 57 include inner ends 61 and outer second ends 62. As shown, headers 51 and 52 each include a female receptacles 63. The inner ends 61 of the risers 56 and 57 are complementary male fittings 67 each including a plurality of o-rings 64. See FIG. 6 and FIG. 7.

The risers 56 and 57 are supported by an elongated aligning brackets 66. The aligning brackets can either be of the same configuration as the bracket 43 shown in FIG. 4 or alternately can be a bracket such as bracket 69 shown in FIG. 8. With either of these brackets, the risers are precisely aligned by the edges of the bracket. With respect to the embodiment shown in FIG. 4, the flanges 45 and 46 which extend into grooves 41 and 42 precisely align the risers. With respect to the embodiment shown in FIG. 8, the side edges 71 and 72 of bracket 69 engaged the tubular portions 73 and 74 which lead to the nozzles. The riser itself is held to the bracket 69 by U-bolts 75. The outside end 76 of bracket 69 or bracket 43 includes a spring-loaded stop-pin 78. (See FIGS. 5, 6 and 7).

Figure 6:
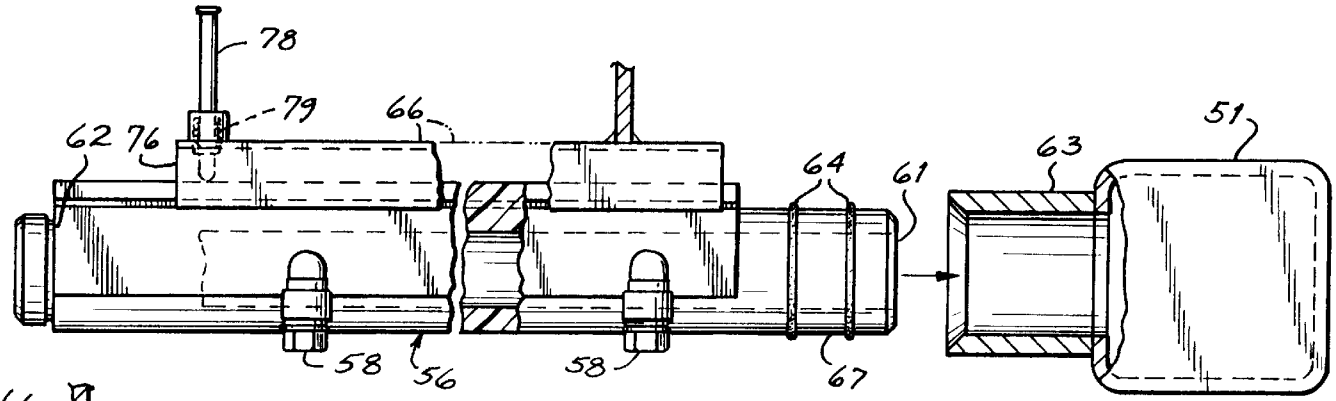
Figure 7:
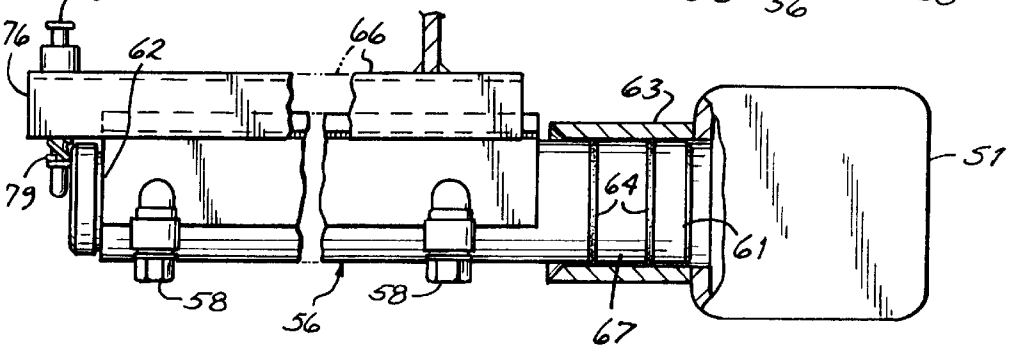

As shown in FIG. 6 and FIG. 7, the risers 56 and 57 attach to the headers by inserting the male portion 67 into the female receptacles 63. The o-rings 64 will maintain a tight seal. As the riser slides along the bracket, the spring-loaded pin 78 is in a raised position as shown in FIG. 6. As outer end 62 of riser passes beyond the pin 78, the pin is forced downwardly by spring 79 into a locked position shown in FIG. 7. Thus, the end 62 of risers 56 and 57 will engage the pin preventing the riser from being forced off of the header by water pressure.

Figure 8:
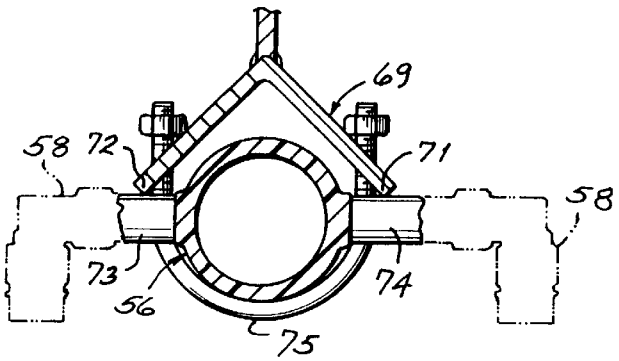

With the embodiment shown in FIG. 8, once the risers are connected to the header the U-bolts would then be fastened holding the riser in position. The bracket 69 will maintain the riser in a straight orientation in the precisely desired location with the axial position of the riser and specifically the nozzles maintained in the desired location by engagement of the edges 72 and 71 of bracket 69.

This permits one to remove the risers without access to the header and at the same time maintain the risers in precise alignment which eliminates the need for any type of guiding fastener in the connection between the riser and the header. Likewise this eliminates the need for any cam fitting as shown in the embodiment in FIG. 1.

This allows a single individual to remove the riser and is particularly suitable for plastic risers although the same embodiment can be used for metal risers. Further, it permits the header to be formed from plastic. This greatly reduces the amount of metal in the can washing apparatus. This is preferred since the plastic is more suitable for the environment of the can washing apparatus. P With either embodiment of the present invention, the plastic riser is held along substantially its entire length by a rigid support which does not need to be removed from the can washing apparatus in order to clean the riser. Thus, the riser can simply be disconnected from the support member and removed using the quick-disconnect fitting holding it to the header. The riser itself is light enough that it can easily be removed by a single individual. This significantly reduces the cost of maintenance and makes it easier to provide maintenance on the equipment.

This has been a description of the present invention along with the best mode of practicing the invention known to the inventor, however, the invention itself should be defined only by the appended claims wherein:

What is claimed is:

1. A can washing apparatus comprising a conveyor supporting an array of cans;

a header;

a plurality of plastic risers in fluid communication with said header;

a plurality of nozzles extended from said risers, said nozzles directed toward said conveyor and said cans;

a plurality metal supports extended along said risers, said supports mounted to said washing apparatus wherein said risers are held firmly against said metal supports thereby preventing said risers from flexing during use whereby fluid sprayed from said nozzles contacts and cleans said cans supported on said conveyor without knocking over said cans.

2. The apparatus claimed in claim 1 wherein said support is a U-shaped channel.

3. The apparatus claimed in claim 2 wherein said support is held to a frame of said apparatus by at least one arm.

4. The apparatus claimed in claim 2 wherein said riser is connected to said channel with a plurality of U-shaped connectors.

5. The apparatus claimed in claim 2 wherein said nozzles are directed in a first direction wherein said riser is mounted with a side of said riser opposite said first direction fixed to said channel.

6. The apparatus claimed in claim 1 wherein said risers are held to said header with quick-disconnect fittings.

7. The apparatus claimed in claim 1 further comprising a plastic fluid supply line connected to said header.

* * * * *